US008870244B2

(12) United States Patent
Liang et al.

(10) Patent No.: US 8,870,244 B2
(45) Date of Patent: Oct. 28, 2014

(54) SASH LOCK WITH SIGNAL

(75) Inventors: Luke Liang, So. Plainfield, NJ (US); Tong Liang, Guang Zhou (CN); David Chen, Guang Zhou (CN)

(73) Assignee: Vision Industries Group, Inc., So. Plainfield, NJ (US)

( * ) Notice: Subject to any disclaimer, the term of this patent is extended or adjusted under 35 U.S.C. 154(b) by 682 days.

(21) Appl. No.: 13/065,462

(22) Filed: Mar. 22, 2011

(65) Prior Publication Data

US 2011/0248516 A1 Oct. 13, 2011

Related U.S. Application Data

(63) Continuation-in-part of application No. 11/824,576, filed on Jun. 29, 2007, now Pat. No. 8,414,039.

(60) Provisional application No. 60/817,612, filed on Jun. 29, 2006.

(51) Int. Cl.
*E05C 1/12* (2006.01)

(52) U.S. Cl.
USPC ..... 292/173; 292/DIG. 4; 292/DIG. 20

(58) Field of Classification Search
USPC ..... 292/173, 335, DIG. 4, DIG. 20, DIG. 47
See application file for complete search history.

(56) References Cited

U.S. PATENT DOCUMENTS

| | | | | |
|---|---|---|---|---|
| 1,302,873 | A * | 5/1919 | Stiff | 292/335 |
| 3,621,686 | A * | 11/1971 | Klein | 70/157 |
| 5,292,159 | A * | 3/1994 | Sandhu et al. | 292/173 |
| 7,118,142 | B2 * | 10/2006 | Xu | 292/139 |
| 7,383,707 | B2 * | 6/2008 | Yamada et al. | 70/208 |
| 8,414,039 | B2 * | 4/2013 | Liang et al. | 292/240 |

* cited by examiner

*Primary Examiner* — Mark Williams
(74) *Attorney, Agent, or Firm* — Thomas A. O'Rourke; Bodner & O'Rourke, LLP

(57) ABSTRACT

A sash lock comprises a housing, latch member, activator arm, and trigger. The latch member is spring biased to slide from an unlocked position towards a locked position. The activator arm and trigger are pivotally mounted within the housing, with a torsion spring biasing the trigger relative to the activator arm, to cause the activator arm to pivot and contact the latch member. When the latch member is moved to the unlocked position, the biased activator arm engages the latch member to retain it in the unlocked position, while the biased trigger member pivots to have a portion protrude out of the housing. Upon closing the sash member, an angled surface of a keeper contacts a curved surface of the protruding trigger to cause it to counter-rotate and drive the activator arm to disengage from the latch member and automatically permit biasing of the latch member into the locked position.

18 Claims, 12 Drawing Sheets

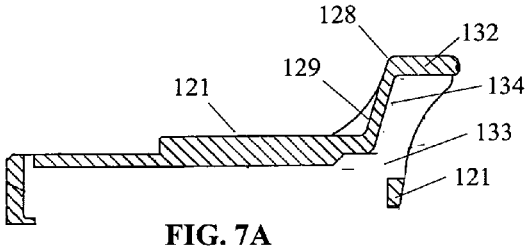
FIG. 7A
FIG. 7
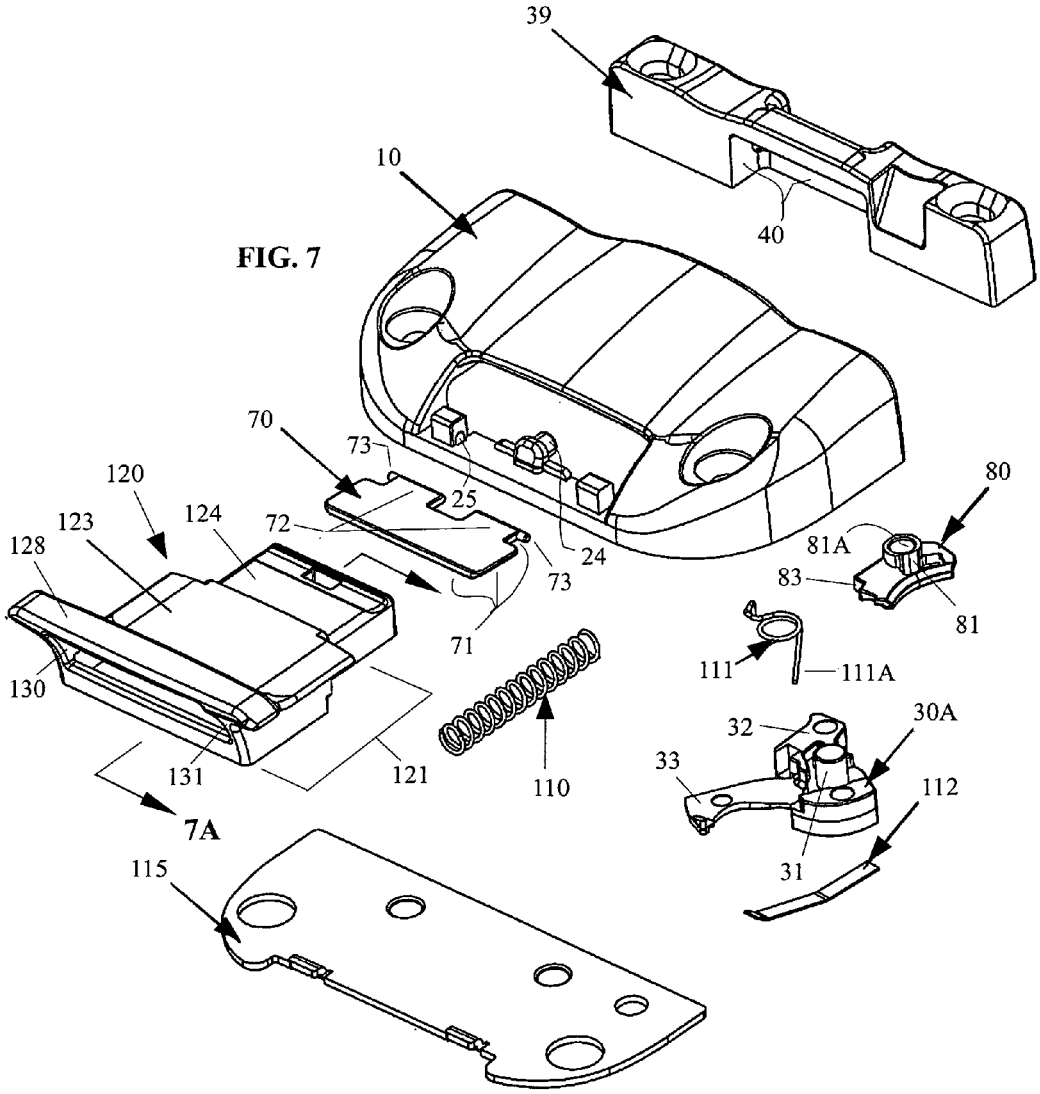

SASH LOCK WITH SIGNAL

CROSS REFERENCES TO RELATED APPLICATIONS

This application is a continuation-in-part of U.S. patent application Ser. No. 11/824,576, filed on Jan. 17, 2008, which claimed priority on U.S. Provisional Patent Application Ser. No. 60/817,612, filed on Jun. 29, 2007, the disclosures of each being incorporated herein by reference.

FIELD OF THE INVENTION

The present invention relates to an improved automatic sash lock and sash lock with a signal mechanism for determining whether the sash lock is in a locked position or an unlocked position.

BACKGROUND OF THE INVENTION

Sash locks are very common on double hung windows. In many locations such as homes and businesses, the windows may be opened at certain times of the day or evening for ventilation or natural cooling and later closed. As a security measure, these windows are usually locked when people are alone in their homes or when the establishment is closed.

Since many buildings have a number of windows, it can be a chore and quite time consuming to individually check each window to make sure it is locked. As a result, there have been several indicators that provide a signal to the user to notify the user whether the window is locked. One such sash lock is disclosed in U.S. application Ser. No. 10/932,883 filed Sep. 2, 2004, the disclosures of which are incorporated herein by reference. This lock uses a flag which can be raised or lowered to signal whether the window is in a locking condition. Another sash lock is disclosed in U.S. Ser. No. 11/254,065 filed Oct. 19, 2005, which discloses a sash lock with a housing. The housing has a status indicator in the housing that permits a user to determine if the window is in an unlocked condition. The sash lock in that application has a color indicator to inform the user of the status of the lock.

OBJECTS OF THE INVENTION

It is an object of the present invention to provide an improved locking mechanism for a sash lock.

It is another object of the invention to provide a sash lock with an automatic locking feature.

It is also an object of the invention to provide a sash lock that locks when a trigger contacts the keeper used with the lock.

It is another object of the present invention to provide an improved indicator for a sash lock that provides a visual indication whether a sash lock is in a locked position or an unlocked position.

It is another object of the invention to provide a combination lock and keeper that coact to signal the status of the sash lock.

It is a still further object of the invention to provide a sash lock with a unique visual indicator for determining whether a sash lock is in a locked configuration or an unlocked configuration.

Further objects and advantages of the invention will become apparent from the following description and claims, and from the accompanying drawings.

SUMMARY OF THE INVENTION

The sash lock of the present invention includes a housing and a separate base or protective member. The housing has a top surface and bottom surface. Extending from the top surface are a pair of side walls. The housing also has a front face and a rear face. At least a portion of the front face is open to permit a tongue to extend therefrom the secure the lock to a keeper. The open front face may have a hood that extends outwardly that may be adapted to receive a keeper so that the keeper is hidden by the top surface or hood of the housing. Alternatively, the housing has a top surface where the hood does not extend over the keeper. There is a locking mechanism that secures the sash lock to the housing. The locking mechanism is preferably an automatic one in which the sash lock becomes locked automatically when a portion of the keeper is contacted. In a preferred embodiment, the locking mechanism has a tongue that has a retracted position when the lock is in an unlocked configuration and an extended position when the lock is in a locked configuration. The tongue is preferably spring driven from the retracted position to the extended position. In the preferred embodiment, the tongue is released from the retracted position to the extended position by means of a trigger.

The tongue may be generally rectangular in cross section with a top surface and a pair of side surfaces. The bottom of the tongue may be open and receive a spring that provides a force causing the tongue to extend when the tongue is released by the trigger. The tongue extends from an open portion of the front face of the housing when in an extended position and is generally flush with the front face or slightly recessed when the tongue is retracted. The tongue remains in its recessed position until activated by a trigger. The trigger may be a pin or other suitable trigger means that extends outwardly from the front face of the housing and can contact the keeper of the window sash to release the tongue. When the trigger contacts the keeper, the tongue is released and the tongue extends to a locking position.

The keeper has a top surface, a front wall and a rear wall. Connecting the front and rear walls are a pair of end walls. The top surface typically has one or more orifices for securing the keeper to a sash. Screws or other securing means can be used to secure the keeper to a sash. The top surface and/or the front surface of the keeper have an open area for receiving a the trigger which might be for example a locking tab that extends from the underside of the top surface of the sash lock housing, i.e. below the bottom surface of the sash lock housing. When the sashes of the window to be locked are approaching a closed arrangement, the trigger such as a tab on the sash lock is positioned in the open area of the keeper. As the sash lock and keeper are positioned in a locking arrangement when the window closes, the keeper hits the trigger and the tongue is forced out by the spring. Alternatively, the trigger hits the keeper thus forcing the tongue to extend from the housing into a locking position. The tongue may extend into a recessed area in the front wall of the keeper whereby it prevents the sashes from being separated until the tongue is retracted back into the housing. The extended tongue and the tab on the sash lock housing hold the sash lock to the keeper and retain the windows in a locked condition.

In a preferred embodiment of the present invention, the tongue is connected to a pull tab. The pull tab permits a user to unlock the sash lock by retracting the tongue into its recessed, loaded position. The pull tab preferably has a handle portion so that a user's hands can more easily grasp the pull tab. The pull tab may have portion thereof where there is a signal means to signal whether the tongue is in a retracted or unlocked condition or extended in a locked arrangement. Preferably, a rear surface of the pull tab has a signal means. When the tongue is in an extended position, i.e. a locking position, the signal means reflects that position. The signal means shows that the tongue is in a recessed condition when the pull tab has been pulled back. Preferably the signal means is red when the lock is in an unlocked position. When the lock is in a locked position, the signal means will reflect another color.

BRIEF DESCRIPTION OF THE DRAWINGS

FIG. 7 is a second exploded view of the component parts of an alternate embodiment of the sash lock.

DETAILED DESCRIPTION OF THE INVENTION

Figure 1:
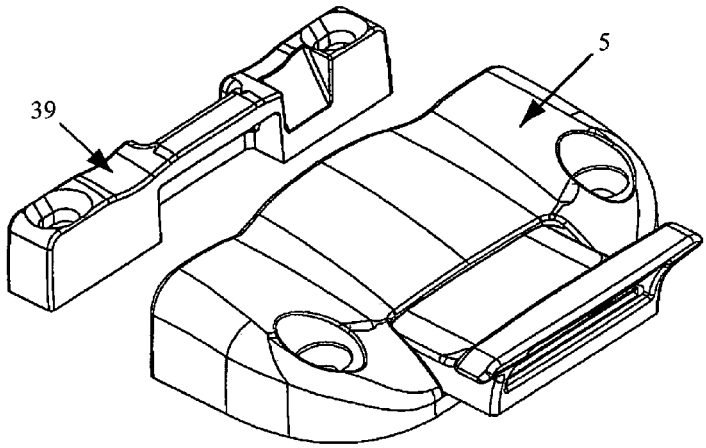
FIG. 1 is a top perspective view of the sash lock and keeper of the present invention.
Figure 2:
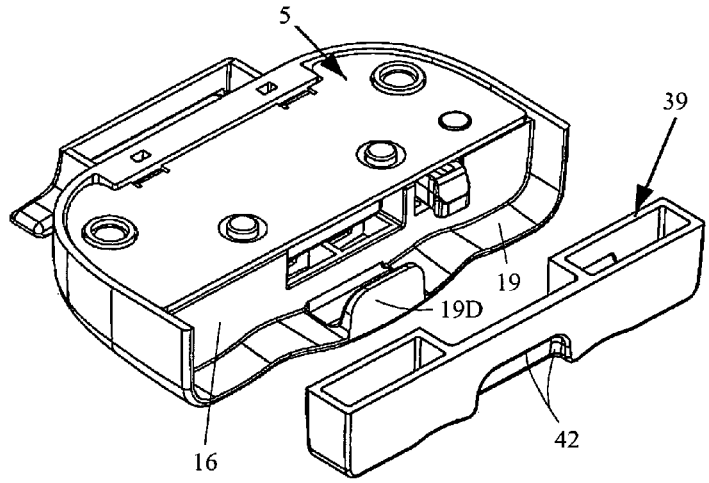
FIG. 2 is a bottom perspective view of the sash lock and keeper of the present invention.
Figure 3:
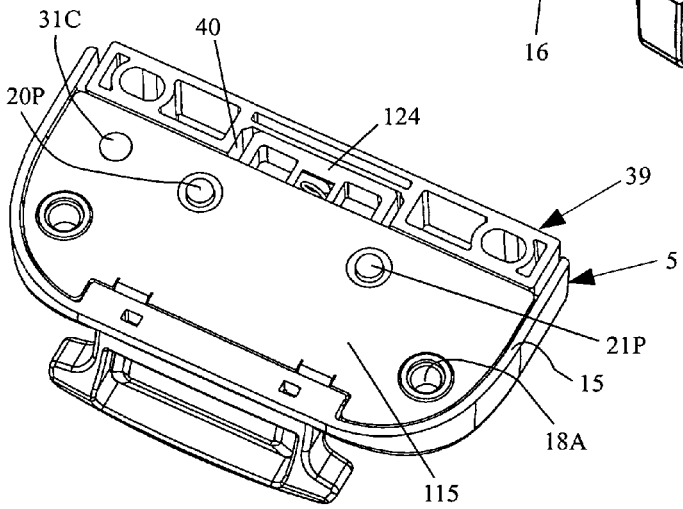
FIG. 3 is the bottom perspective view of FIG. 2, but shown with the keeper being engaged by the sash lock.

FIGS. 1 and 2 show the sash lock 5 and associated keeper 39 of the current invention, with the keeper being displaced laterally from the lock for visualization purposes, which is not, in fact, how the two components interact when used on, for example, a sash window. As will be discussed in detail hereinafter, the interaction occurring through the raising and lowering of a sash member (see FIGS. 9A-9F) would result in the keeper 39 being received within the sash lock 5, as seen in FIG. 3.

Figure 4:
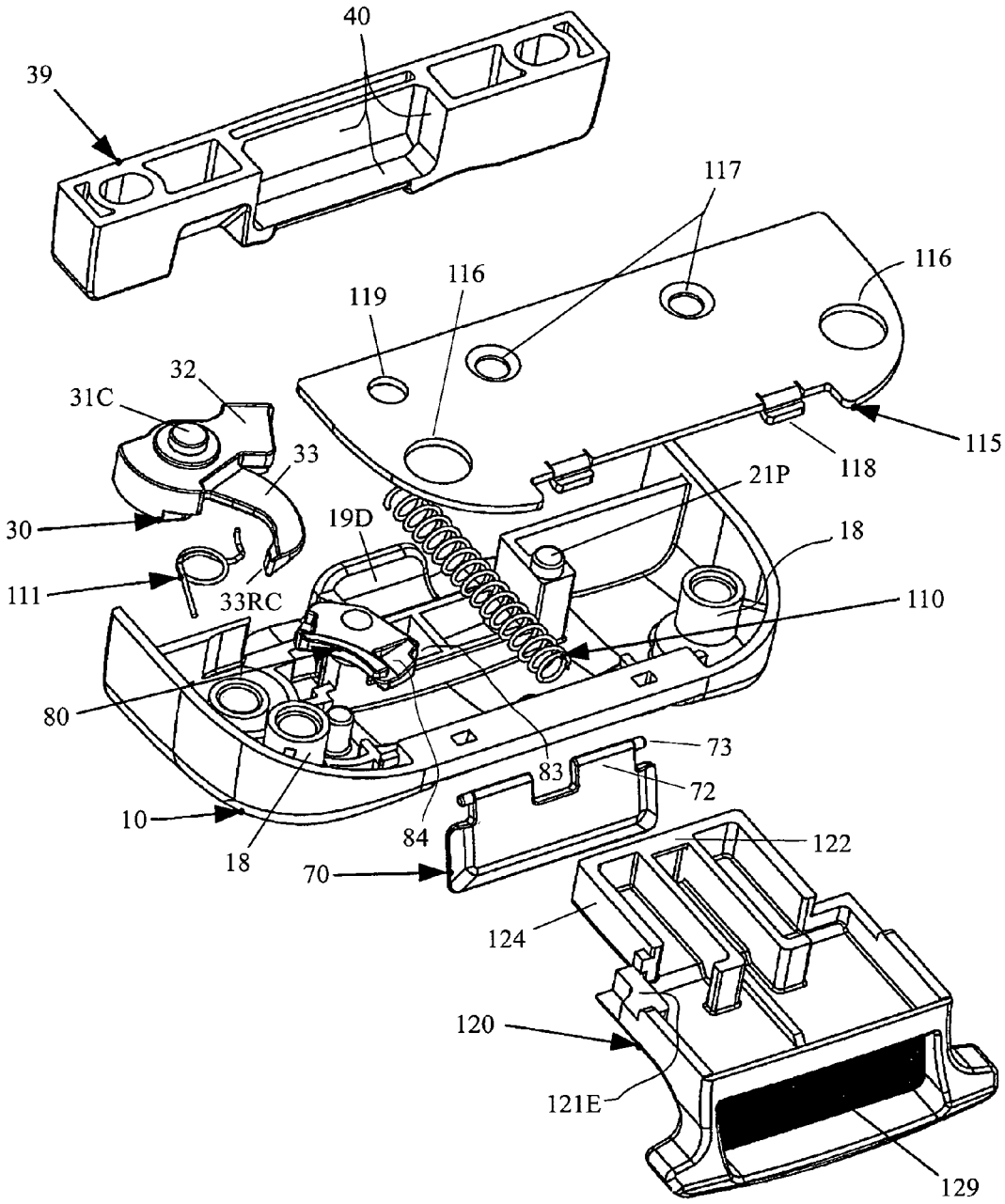
FIG. 4 is a first exploded view of the component parts of the sash lock of the present invention.
Figure 5:
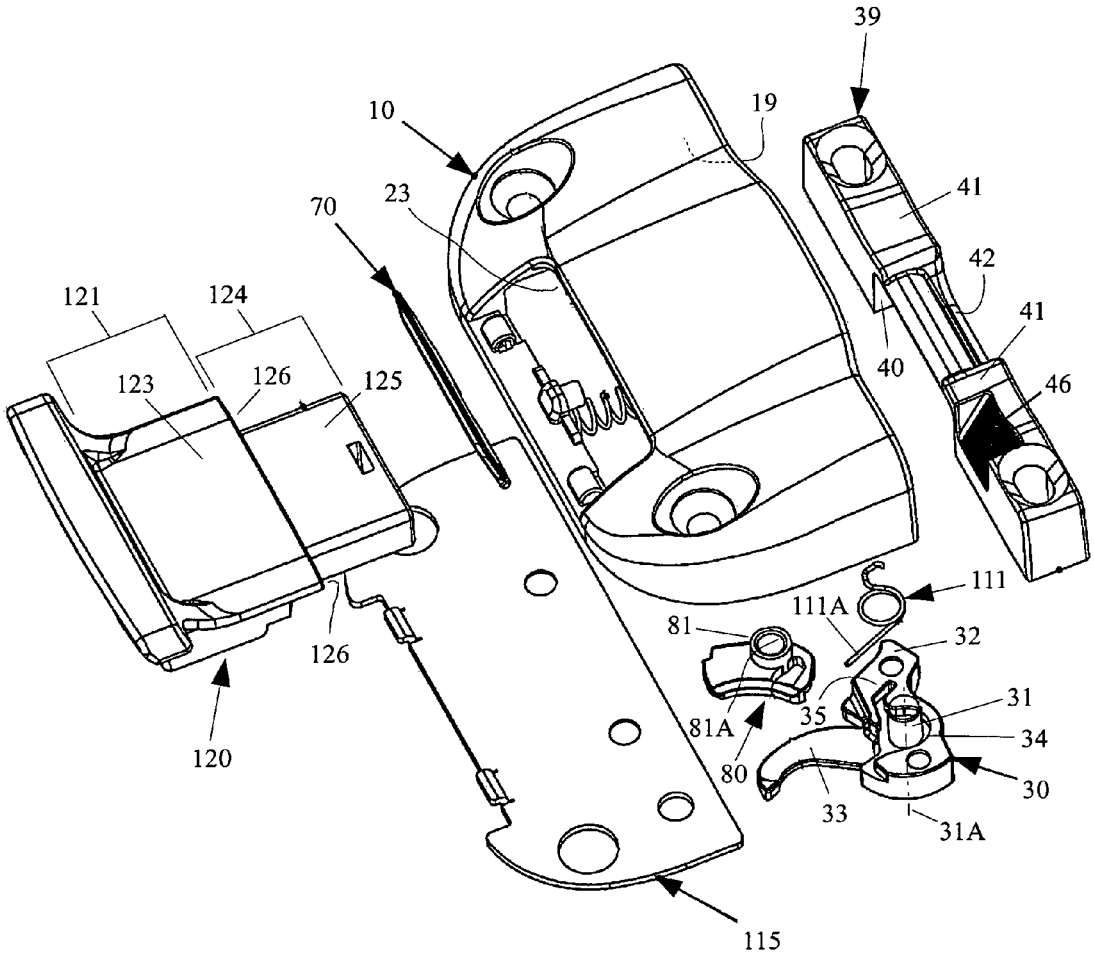
FIG. 5 is a second exploded view of the component parts of the sash lock of the present invention.
Figure 6:
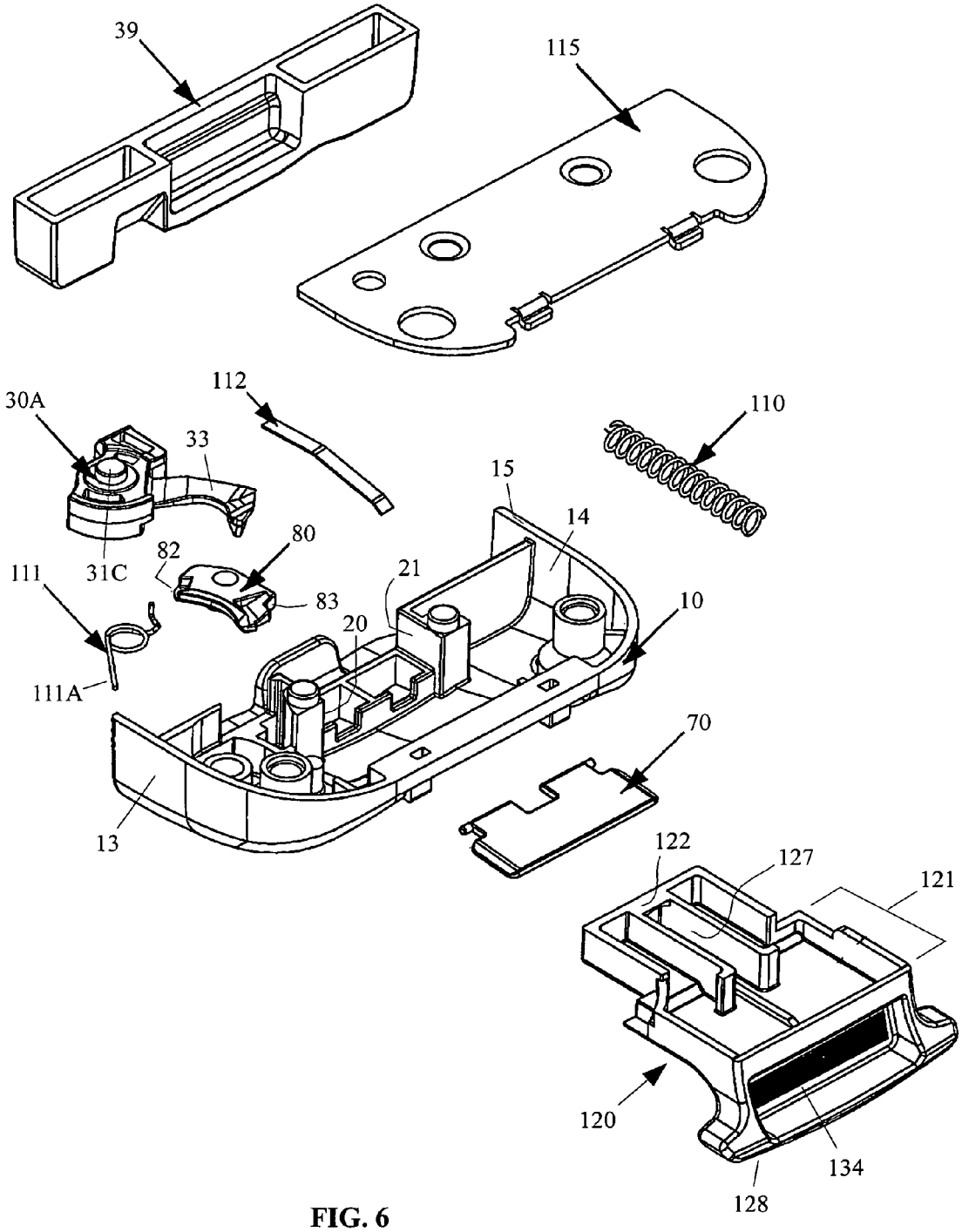
FIG. 6 is a first exploded view of the component parts of an alternate embodiment of the sash lock of the present invention.

The component parts of the sash lock 5 may be a housing 10, a latch member 120, a latch biasing means, which may preferably be in the form of a helical compression spring 110, an activator arm 80, a trigger member 30, and a torsion spring 111. Two different exploded views of the parts comprising the sash lock 5 are seen in FIGS. 4 and 5, while FIGS. 6 and 7 show two exploded perspective views of the parts comprising an alternate embodiment in the form of sash lock 6. Sash lock 6 may be the same as sash lock 5, except for the trigger 30A being a modified version of trigger 30, so as to be able to receive a leaf spring member 112, which will be discussed later.

Figure 8B:
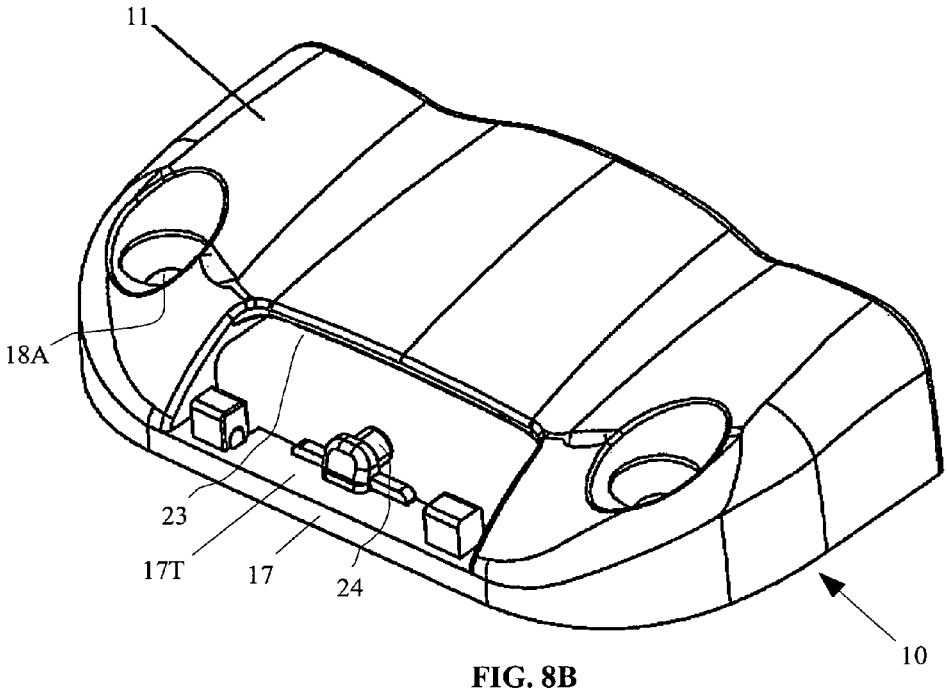
FIG. 8B is a bottom perspective view of the sash lock housing.
Figure 8A:
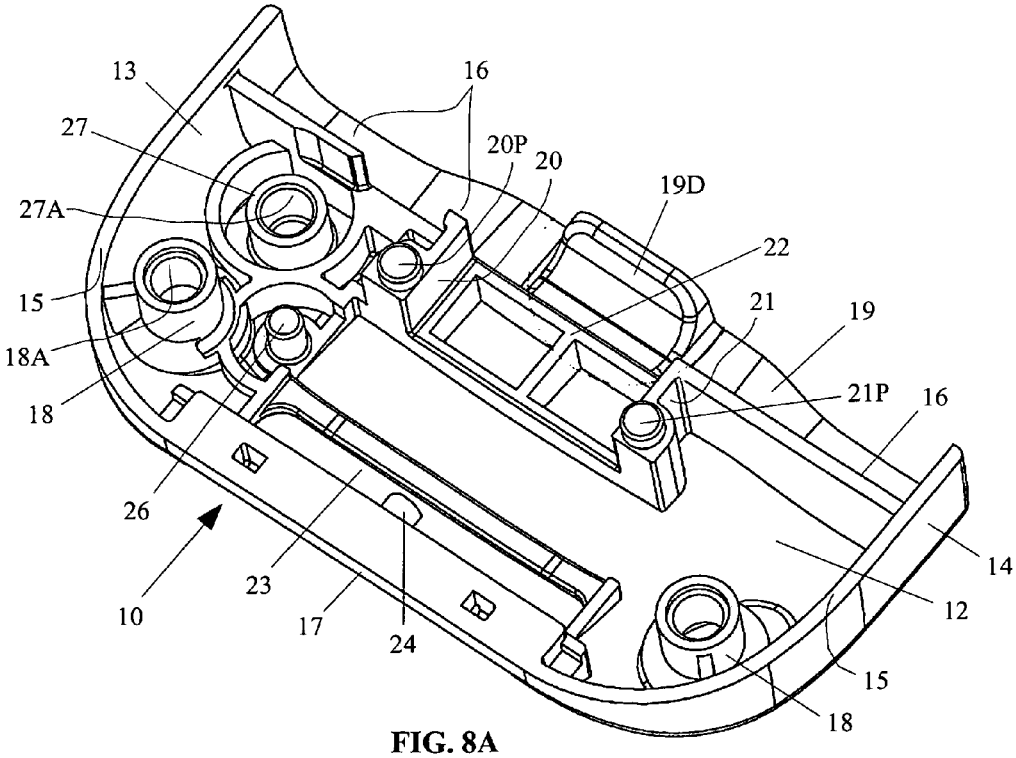
FIG. 8A is a top perspective view of the sash lock housing.
Figure 9B:
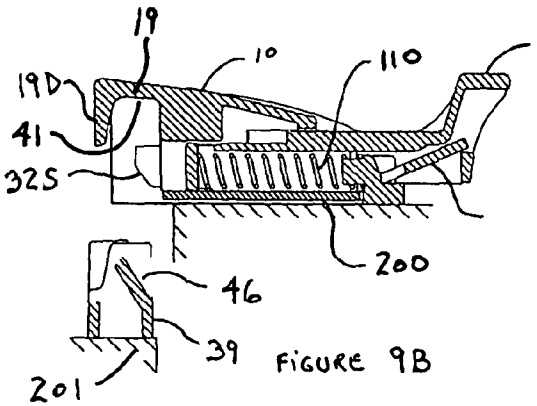
FIG. 9B is a side cross-sectional view of the sash lock of FIG. 9A, shown mounted to a sash member, and displaced from a keeper that is mounted to a corresponding sash member.
Figure 9A:
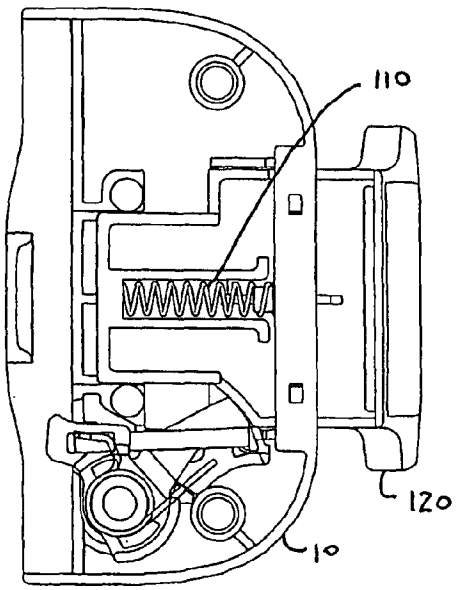
FIG. 9A is a bottom view of the sash lock of the present invention, shown in the unlocked position.
Figure 9D:
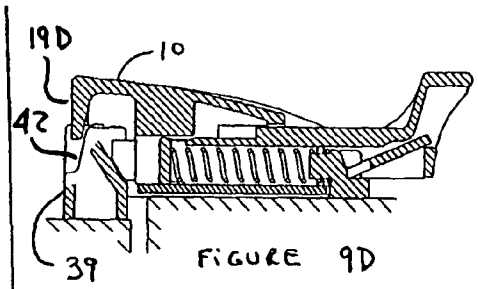
FIG. 9D is the side cross-sectional view of the sash lock of FIG. 9B, but with the upper sash member slid down so that the protruding portion of the trigger just contacts the angles surface of the keeper mounted to the other sash member.
Figure 9C:
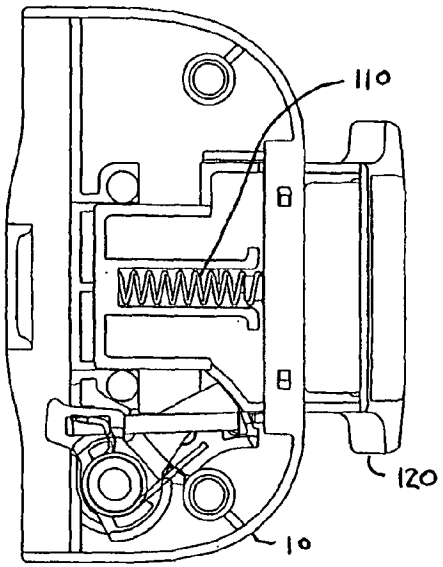
FIG. 9C is the sash lock bottom view of FIG. 9A.

The housing 10 is shown separately in FIGS. 8A and 8B. Although the housing 10 may assume a variety of different shapes while nonetheless supporting the automatic locking mechanism that is disclosed hereinafter, the housing 10 may preferably have an upper wall defined by a top surface 11 and a bottom surface 12, and a first sidewall 13 and second sidewall 14. The first and second sidewalls 13 and 14 may curve together into a rear wall 17 to form a housing cavity. Extending inward into the housing cavity from sidewall 13 and from side wall 14 may be a front wall 16 (see also FIG. 2). The front wall 16 may be interrupted to leave a small opening to permit the trigger to protrude therefrom, which is discussed in more detail hereinafter. Extending into the housing cavity and away from front wall 16 may be interior walls 20 and 21. Front wall 16 may also have an opening between interior walls 20 and 21. Connecting a portion of the interior walls 20 and 21 may be a flat pad 22, which may be pocketed to remove unnecessary weight from the housing. The walls 13, 14, 17, 20, and 21 may all share a co-planar bottom surface 15, which may be in contact with a sash member 200 when the sash lock 5 is installed thereon (FIG. 9B). Also, the housing wall defined by top surface 11 and bottom surface 12 may overhang beyond the front wall 16 to form a "hood" 19, from which may protrude a down-standing flange 19D.

Protruding into the cavity from the bottom surface 12 of housing 10 may be two or more posts 18, having a thru-hole 18A therein, which may be usable in securing the sash lock 5 to the sash member 200, using mechanical fasteners that may include, but not be limited to, screws. As seen in FIG. 8B, the wall defined by top surface 11 and bottom surface 12 may have therein an opening 23, which creates a flat top surface 17T in rear wall 17. Opening 23 of the housing 10 may be used to slidably receive the latch member 120.

Latch member 120, as seen in FIG. 5, may have a body portion 121, which may narrow on one end of the latch member to form a tongue 124. The latch member 120 may be received through opening 23 of housing 10 such that bottom surface 122 of the latch member 120 (FIG. 4 or 6) is supported by the flat top surface 17T of rear wall 17 (FIG. 8A), and top surface 123 of the latch member 120 (FIG. 5 or 7) is similarly supported by the housing, and with the top surface 125 of the tongue 124 being in contact with and supported by the flat pad 22 between interior walls 21 and 22. The width of the tongue 124 may be sized to fit between interior walls 21 and 22 in a clearance fit. The latch member 120 may thus be slidable within the cavity of the housing 10, and may be slidable between an unlocked position, and a locked position. In the locked position, latch travel is limited by the width of the latch body exceeding that of the tongue on both sides, designated by reference number 126 on FIG. 5, contacting the ends 20A and 21A of interior walls 20 and 21 (See FIG. 18). The amount of slidable travel of the latch member 120 to reach the unlocked position may be a function of the locking mechanism details and/or a stop, which is discussed further hereinafter. The latch member 120 may be biased towards the locked position using any biasing means known in the art. The biasing means may, for example be a tension spring, or, as is shown in the figures, a helical compression spring 110 may instead be used. The housing 10, as seen in FIG. 8A, may comprise a cylindrical post 24 to receive one end of spring 110, while the other end of the spring may be received in a recess 127 in the bottom of the latch member 120 (FIG. 6), with this exemplary biasing arrangement being clearly visible in FIGS. 9A-9F.

The end of latch member 120 opposite to that of the tongue 124 may have a graspable handle 128. Handle 128 may comprise a flange 129, and first and second sidewalls 130 and 131 that extend upward from the top of the body 121 of latch member 120, as seen in FIG. 7, and which may form an opening 133 leading into the recessed area on the bottom of the latch member (FIG. 7A). The back surface of the flange 129 of the handle 128 may comprise a signal area 134 (FIGS. 6 and 7A). The signal area 134 may comprise a visual signal or indicator to alert a user as to when the latch member 120 is in a locked position or an unlocked position. The visual indication provided by signal area 134 may comprise that area being coated/painted with a conspicuous color, such as bright red color. The signal area 134 may be selectively visible so that when the latch member is in a unlocked position, the bright red color may be seen by the sash lock user who may have opened the sash window, but the signal area 134 may be masked or appear to be a different color when the latch member is in an locked position. Other visual indicators may also be used in place of, or in addition to, the bright colored area, including words or other symbols, such as "UNSAFE" of "UNLOCKED."

Figure 8C:
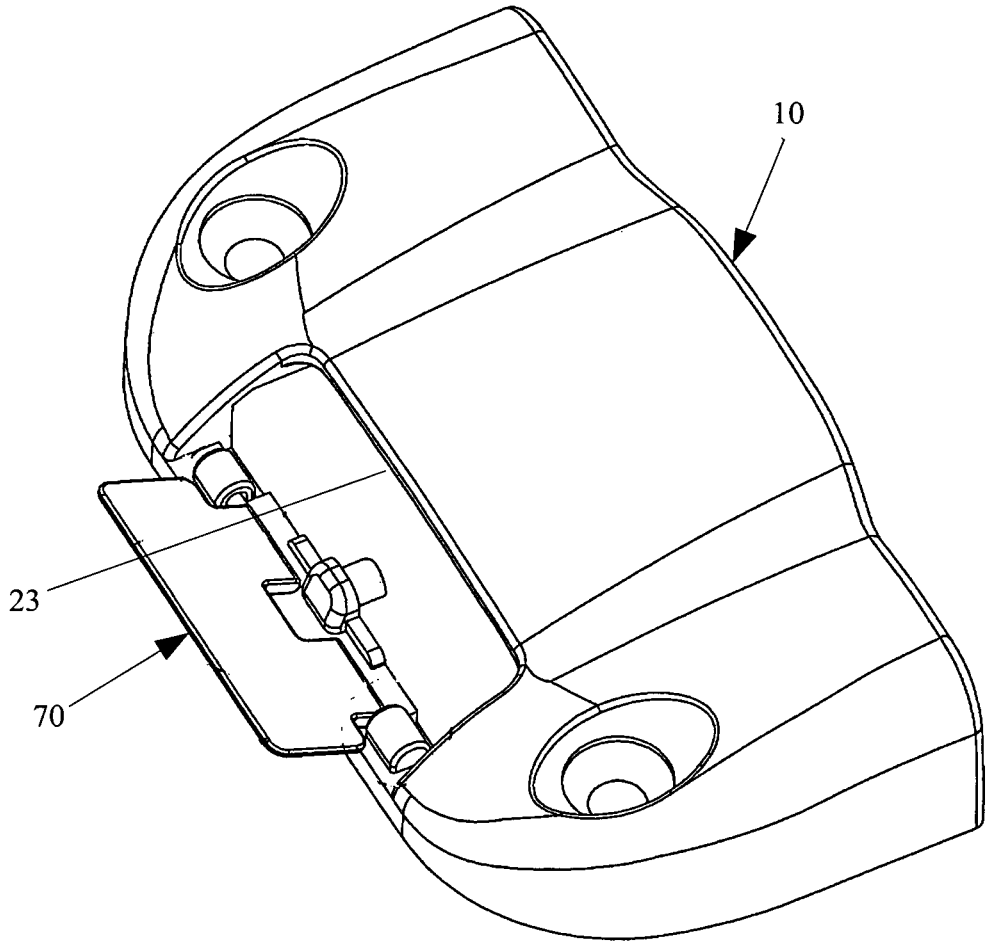
FIG. 8C is a top perspective view of the sash lock housing and the pivotable signal plate.

The selective visibility of the signal area 134 may be provided by a pivotable signal plate 70. As seen in FIG. 7, the pivotable signal plate 70 may simply be a thin flat piece of material with a generally rectangular peripheral edge 71 that is sized to be able to mask the signal area 134 of the latch member. The material may include, but not be limited to, a suitable plastic material. Extending away from the rectangular periphery may be a pair of flanges 72, from each of which may be a laterally protruding post 73. The flanges 72 may serve to provide the signal plate 70 with clearance from the cylindrical post 24 and the cylindrical post's mounting upon the housing 10, when the protruding posts 73 are used to mount the signal plate 70 within the orifices 25 of the housing, as seen in FIGS. 7 and 8C.

Figure 10:
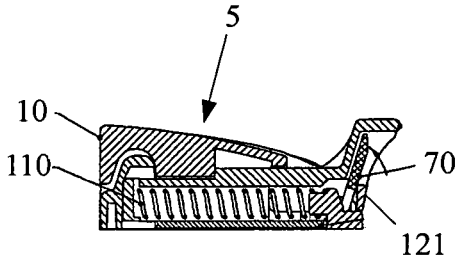
FIG. 10 is a side cross-sectional view of the sash lock in the locked position, and the signal plate in the upright position.
Figure 11:
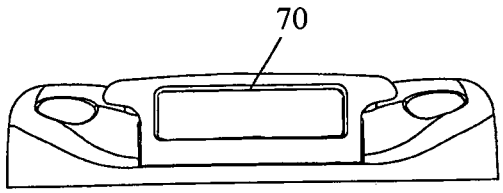
FIG. 11 is a rear view of the sash lock of FIG. 10, showing the hinged signal plate masking the visual signal.

The selective visibility of the signal area 134 on the latch member 120 may be achieved through the pivoting of the signal plate to mask the signal area at appropriate times. The latch member 120 may be fed through the opening 23 of the housing 10, so as to receive the signal plate 70 through the opening 133 in the body 121 of the latch member. Operation of the signal plate 70 to provide the selective visibility may be seen by an examination of FIGS. 10-13. In FIG. 10, the latch member 120 occupies the locked position, and a portion of the body 121 of the latch, while moving into that locked position, has driven the signal plate 70 to be in a mostly upright position, where it will mask the signal area 134. The side of the signal plate 70 that is visible, shown in FIG. 11, may be colored to match that of the exterior of sash lock 5, perhaps being white, or it could be another color to more definitively indicate that the sash lock is locked.

Figure 12:
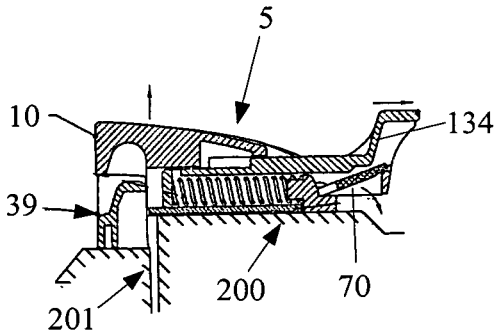
FIG. 12 is the side cross-sectional view of the sash lock of FIG. 10, but with the lock shown in the unlocked position, and the signal plate shown in the lowered position.
Figure 13:
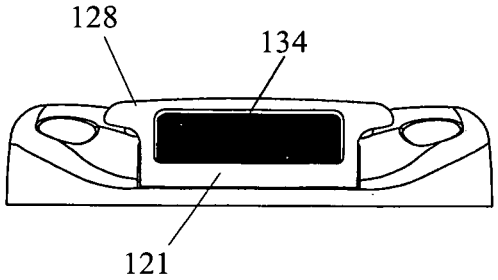
FIG. 13 is a rear view of the sash lock of FIG. 12 to show the signal plate lowered to reveal the visual signal (colored marking).

When the latch member 120 is moved by the user to unlock the sash lock 5, and occupies its unlocked position, shown in FIG. 12, the signal plate 70 may pivot downward under the force of gravity from its mostly upright position, and leave the signal area 134 completely exposed, as seen in FIG. 13. Where the signal area 134 is a bright color, the lock being in the open position may easily be perceived by the user, even from across a room, provided that the bright color of the signal area comprises a sufficiently large surface area. Once the sash member upon which the sash lock 5 is mounted, is closed, the latch member 120 automatically relocks the sash by moving into the locked position, with the raising of the signal plate 70 to be indicative of its locked condition.

Movement of the latch member 120 as described, with its automatic locking feature, is accomplished by the selective interaction of the activator arm 80 and the trigger member 30, as follows. The housing 10 (FIG. 8A) may comprise a post 26 extending into the cavity from surface 12, and may also comprise a post 27 extending into the cavity from surface 12, but which may also have an orifice 27A therein. Posts 26 and 27 may be used for mounting of the activator arm 80 and the trigger member 30, respectively. The underside of the activator arm 80 and the trigger member 30 are visible in FIG. 5 and FIG. 7.

Figure 16:
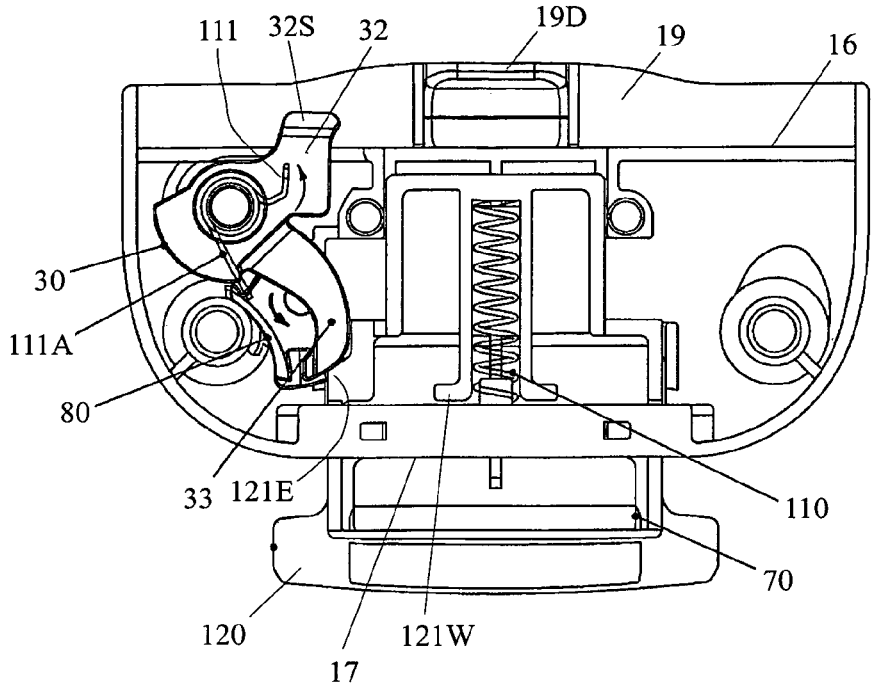
FIG. 16 is a bottom view of the sash, with the lock shown in the unlocked position.

The activator arm 80 may comprise a generally curved member having a cylindrical post 81 with an orifice 81A therein. The post 81 may be located slightly off of the center of the curved arm. The post 81 with orifice 81A may be used to pivotally mount the activator arm 80 within the cavity of housing 10, by receiving the post 26 of housing 10 within the orifice 81A of post 81 of the activator arm, as seen in FIG. 16.

The trigger member 30 may comprise a cylindrical post 31 having a theoretical axis 31A of rotation. The trigger 30 may also comprise a trigger arm 32 extending away in one direction from one portion of the post 31, and an engagement arm 33 extending away in a second direction from another portion of the post 31. On a side of the trigger 30 opposite of post 31 may be a second post 31C that is concentric with the theoretical axis 31A of the post 31. The trigger member 30 may comprise a circular groove 34 that encircles the post 31, and which may transition into an angled groove 35 in proximity to the trigger arm, and which may open up on the side of the engagement arm into a wall 36. As seen in FIG. 5, the circular groove 34 and the angled groove 35 may be used to receive the torsion spring 111 in a fixed relationship, with the arm 111A of the torsion spring 111 bearing up against the wall 36. The combination trigger member 30 and torsion spring 111 may be pivotally installed into the cavity of the housing 10, with the orifice 27A in post 27 of the housing receiving the post 31 of the trigger member.

During this installation, a portion of the end of the arm 111A of torsion spring 111 may be received in a recess 82 in the activator arm 80 (FIG. 6). As may be seen in FIG. 16, this arrangement with the torsion spring 111 fixed to the trigger member 30 but having one end loosely received in the recess 82 in the activator arm 80 serves to create a relative biasing arrangement, whereby the trigger member and the activator arm are biased relative to each other. This relative biasing, with the torsion spring arm 111A contacting the near side of the activator arm 80, results in both the trigger member and the activator arm being biased to "rotate" counterclockwise, as seen in FIG. 16. Hereinafter, in describing the selective interaction of the activator arm 80 and the trigger member 30, this biased counterclockwise movement will be referred to as "rotation" of the parts or of the parts "rotating," and conversely, clockwise movement of those parts will be referred to hereinafter as "counter-rotation" of the parts or of the parts "counter-rotating."

With the latch member 120, helical compression spring 110, signal plate 70, activator arm 80, and the trigger 30/torsion spring 111 combination installed as described within the cavity of housing 10, the cover plate 115 (FIG. 4) may be secured to the housing 10. Cover plate 115 may comprise a pair of orifices 116 that may be sized to receive the housing posts 18 in a clearance fit, as seen in FIG. 3. Cover plate 115 may be secured to the housing orifices 117, which may be countersunk, and which may receive a corresponding number of posts, such as posts 20P and 21P. The posts may protrude from a wall or walls of the housing, such as walls 20 and 21 from which posts 20P and 21P protrude. These posts may be plastically deformed as with the upsetting of a rivet to form a bucked head to trap the cover plate 115 between the wall and the upset head of the post (FIG. 3). Securing of the cover 115 may also include a pair of hooked protrusions 118 that may be retained by a corresponding recess in wall 17 of the housing 10. In addition to enclosing the components of the sash lock 5 and protecting the mechanical arrangement, cover plate 115 may comprise one additional orifice 119 that may receive the post 31C of trigger 30, to further assist the trigger to pivot smoothly within the housing without jamming, since it will be driven by the keeper 39, as discussed hereinafter.

The automatic locking operation of the sash lock 5 is based upon the aforementioned selective interaction, which is illustrated, in part, within FIGS. 16-19. As seen in FIG. 16, when the user has applied a force to the handle 128 of the latch member 120 to withdraw a portion of the latch out from the housing cavity and place the latch into the unlocked position, the relative biasing causes rotation of the activator arm 80 until a notch 83 in the activator arm (FIG. 4) engages an angled edge 121E of the body 121 of the latch member. This engagement is more readily visible in FIG. 19.

The outward travel of the latch member 120 from the housing 10 in FIG. 16 may be appropriately limited by a wall 121W on the underside of the latch body 121 contacting the inside of the housing wall 17. The relative biasing may eventually also result in corresponding rotation of the normally biased trigger member 30, until the engagement arm 33 of the trigger contacts a portion of the body 121 of the latch member 120, at which time a portion of the trigger arm 32 may protrude from the wall 16 of housing 10, to be exposed beneath the housing hood 19. The trigger may not immediately be subject to the corresponding rotation even though the trigger is normally biased to rotate, because of the overall operation of the sash lock 5 with respect to the keeper 39, as seen in FIGS. 9A-9E.

In general, as seen in FIG. 9B, the sash lock 5 may be mounted to a sash member 200, and may travel vertically (or even horizontally) as does the sash member, with locking occurring when the sash member is closed and the tongue 124 of the latch member 120 engages the keeper 39. The keeper may be mounted to a window frame or a second sash member 201, which may or may not be moveable. When the sash member 200 is closed (FIGS. 9E and 9F), the keeper 39 may be received within a portion of the sash lock 5 and thereby prevent the normally biased trigger 30 from correspondingly rotating. But when the sash member 200 is slid so that the sash lock 5 is distal from the keeper 39 (FIGS. 9A and 9B), the trigger is free to rotate due to the relative biasing. The keeper inhibiting the rotation of the trigger is better understood from a more detailed discussion of how the keeper contacting the sash lock causes its automatic locking.

Figure 14:
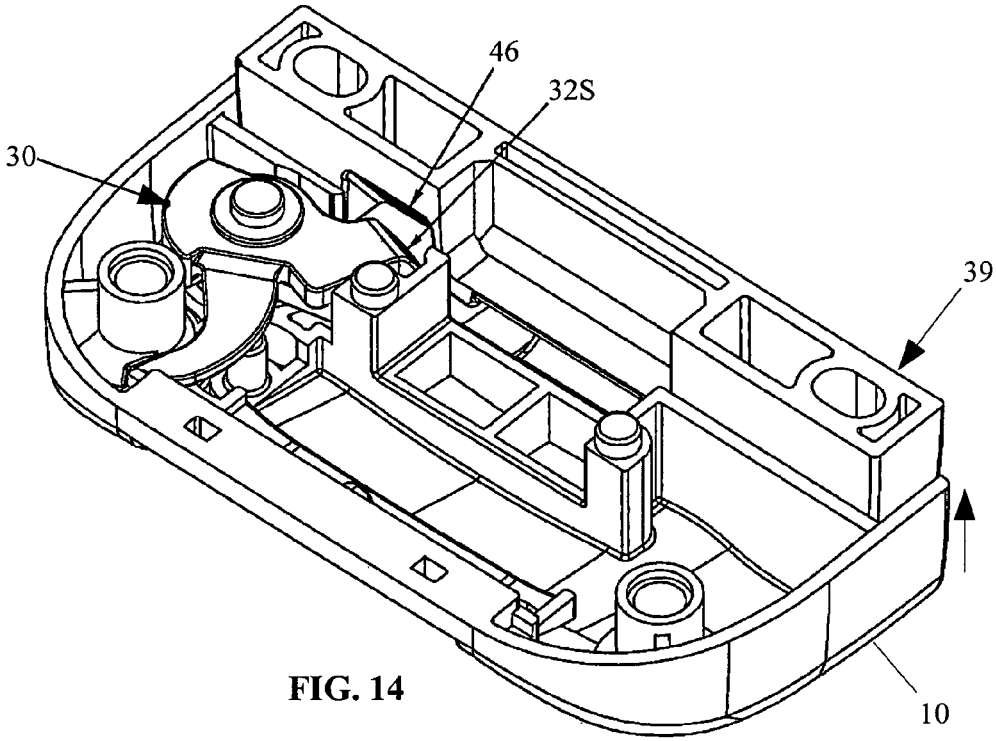
FIG. 14 is a perspective view of the sash lock housing with the trigger mounted therein, and being shown as the sash lock moves to contact a keeper, to illustrate the related contact areas, which are the protruding curved surface of the trigger and the angled surface of the keeper.
Figure 15:
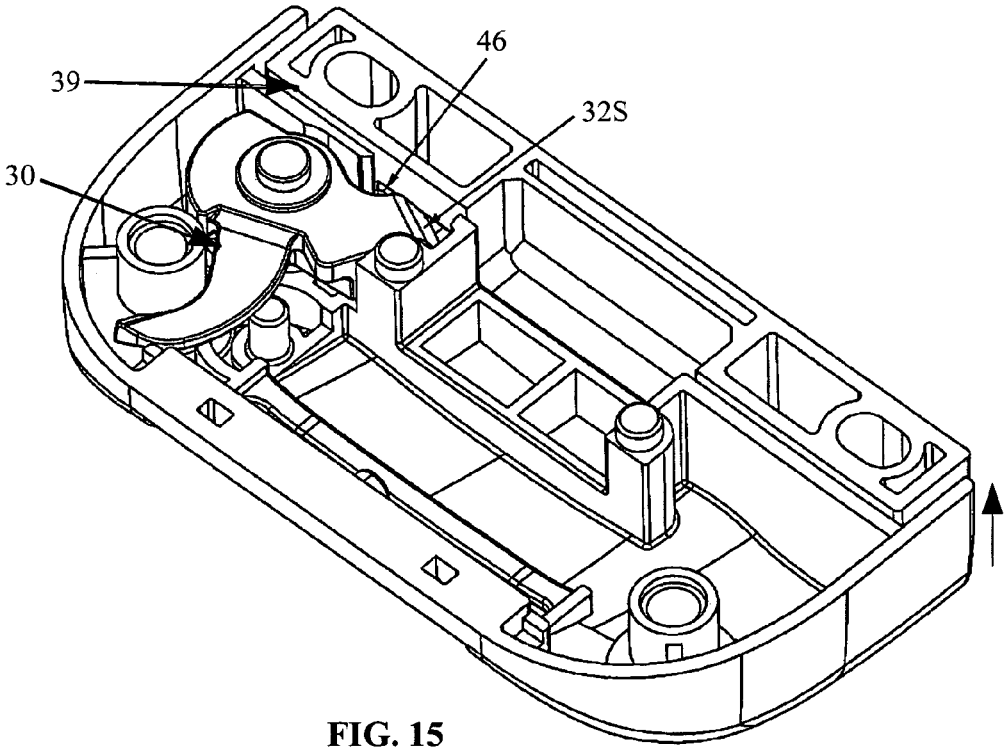
FIG. 15 is the perspective view of FIG. 14, but showing the sash lock having been contacted by the keeper, and with the angled surface on the keeper driving the trigger to counter-rotate.
Figure 17:
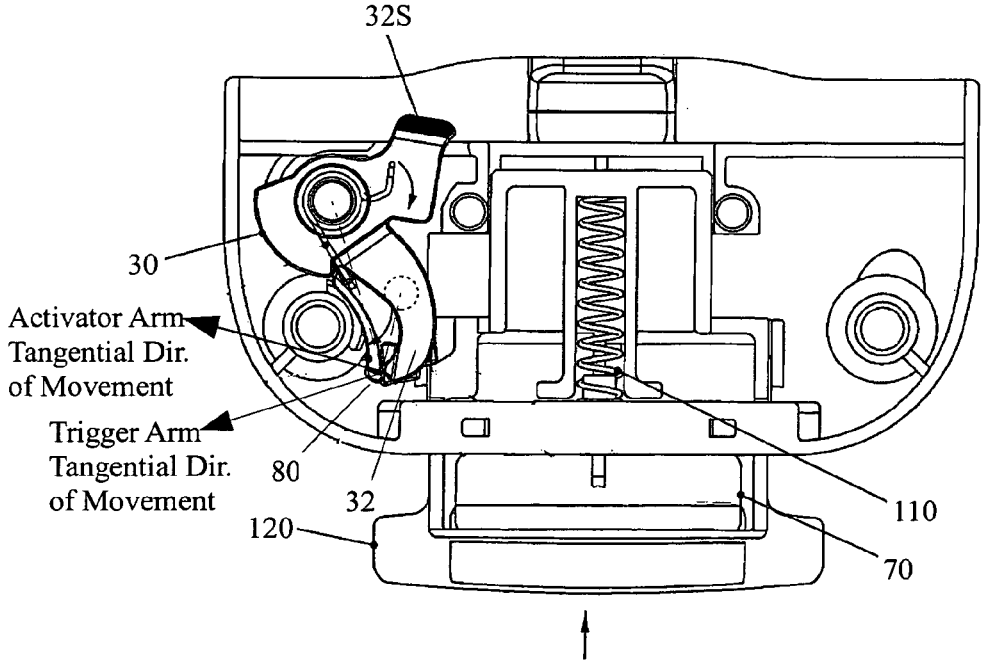
FIG. 17 is the bottom view of FIG. 16, but with the trigger initially being counter-rotated by the keeper, and with the contact region of the trigger beginning to engage the contact region of the activator arm to thereafter drive the activator arm.

FIG. 14 focuses on the trigger arm 32 of trigger member 30 as it may pivot in the housing 10 and how the trigger may contact the keeper 39, and consequently, does not show all of the components of the sash lock 5. FIG. 14 illustrates the curved surface 32S of the trigger arm 32 of the trigger member 30 being approached by the angled surface 46 of the keeper 39. Both the curved surface 32S and the angled surface 46 are shaded within the view to emphasize their extent. As the keeper 39 approaches the sash lock 5 to be received within the housing in proximity to hood 19 (FIG. 15), the angled surface 46 of the keeper 39 contacts the curved surface 32S of trigger 30 and the tangential contact causes the trigger 30 to counter-rotate to initiate the process of automatic re-locking of the sash lock 5. When the trigger member 30 begins to counter-rotate, as is also seen in FIG. 17, the activator arm 80, which initially remains static since it is still biased to engage the latch member in the unlocked position, is contacted by the engagement arm 33 of the trigger.

Figure 9F:
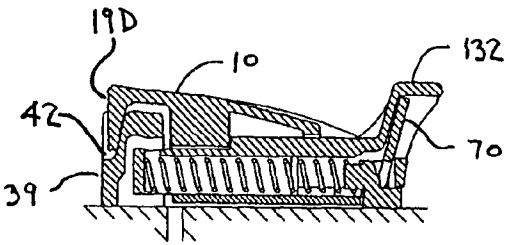
FIG. 9F is the side cross-sectional view of FIG. 9D, but with the upper sash member slid down to be closed, and with the sash lock latch member engaging in the locked position.
Figure 9E:
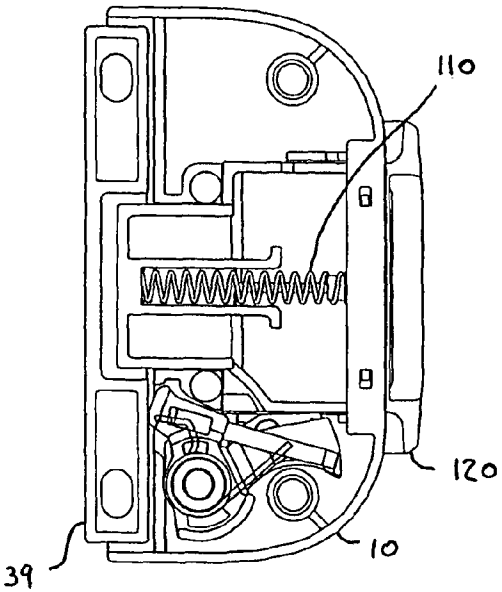
FIG. 9E is the sash lock bottom view of FIG. 9C, but with the sash lock shown in the locked position.

This engagement of the activator arm 80 by the engagement arm 33 of trigger member 30 occurs along a small region of mutual contact between the two parts. As seen in FIG. 4, this region of contact may comprise the small region 33RC on the end of the engagement arm 33 of trigger 30, and a corresponding area 84 on the activator arm 80. FIG. 17 shows the small region 33RC on the trigger's engagement arm 33 engaging the region 84 on the activator arm, after which a small amount of rotation of the trigger, being driven by the keeper contacting the curved surface of the trigger, will cause disengagement of the activator arm 80 from the latch member. Once the notch 83 of the activator arm 80 is disengaged from the angled edge 121E of latch member 120, the helical compression spring 110 may then bias the latch member into the locked position to complete the automatic re-locking of sash lock 5 (FIGS. 18 and 9F).

One additional feature is incorporated into the selective interaction between the trigger member 30 and activator arm 80 of sash lock 5 in order to permit the sash lock to thereafter be unlocked, even while the sash member 200 is still closed and the angled surface 46 of the keeper remains in contact with the curved surface 32S of the trigger to prevent its rotation. Such unlocking is accommodated by the continued contact of the angled surface 46 of the keeper with the curved surface 32S of the trigger 30, to continue causing counter-rotation of the trigger-counter-rotation which must occur before the sash member 200 has been fully closed. This continued contact causes disengagement of the trigger 30 from the activator arm 80. The disengagement occurs because a tangential direction of movement of the small contact region 33RC on the trigger's engagement arm 33 diverges away from a tangential direction of movement of said contact region 84 of the activator arm (see FIG. 17). This causes the trigger 30 to disengage from the activator arm 80 on a side of said activator arm being distal from the activator arm's region of contact 84. The tangential movements diverge, because, as seen in FIG. 17, the pivot location for the trigger 30 and the pivot location for the activator arm 80 are deliberately spaced apart a sufficient amount, such that the diverging tangential movement of the contact regions results in the small contact region 33RC of the trigger "slipping off" of the end of the contact region 84 of the activator arm.

Figure 18:
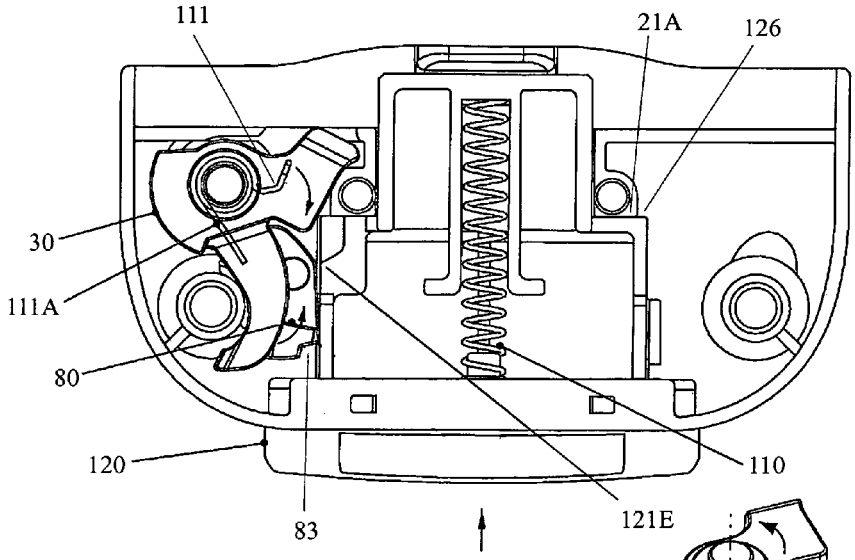
FIG. 18 is the bottom view of FIG. 17, but with the trigger having counter-rotated and driven the activator arm to disengage the activator arm from the latch to permit latch biasing into the locked position, and with the trigger having been counter-rotated additionally by the keeper to thereafter disengage from the activator arm, and be positioned on a side of the activator arm being distal from the contact region of the activator arm.
Figure 19:
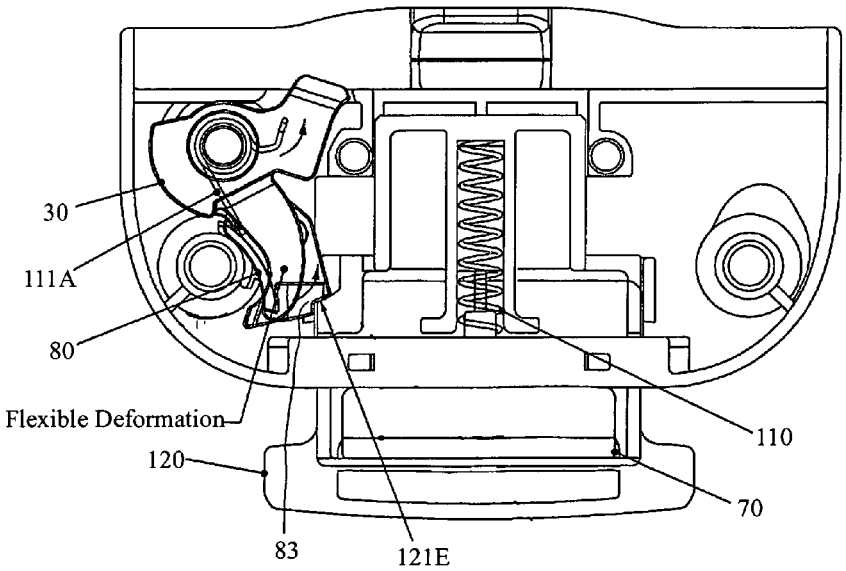
FIG. 19 is the bottom view of FIG. 18, but with latch member moved by the user to the unlocked position to again be secured by the activator arm, and with the disengaged trigger beginning to rotate relative to the activator arm, once the keeper no longer restrains the trigger, and with the trigger contacting the distal side of the activator arm and beginning to deform upward to move past the activator arm.

As seen in FIG. 18, once the trigger arm 33 is disengaged from the activator arm 80, the relative biasing provided by torsion spring 111 causes the unrestrained activator arm to rotate and contact the latch member 120. Once disengaged, the user may then be able to again apply a force to the latch handle 128 of latch member 120 to move the latch to the unlocked position, where notch 83 on the activator arm may again engage angled edge 121E of the body 121 of the latch. Even after the latch 120 is moved to the unlocked position, the trigger 30 remains as positioned in FIG. 18 because it is maintained there by the angled surface 46 of the keeper contacting the curved surface 32S of the trigger, with the sash 200 still remaining in the closed position. Once the sash member 200 is slid vertically (FIG. 9B) so that the keeper 39 is no longer received within the sash lock 5, the trigger 30 may then begin to rotate, as seen in FIG. 19. However, its free rotation is impeded because the tangential direction of movement of the engagement arm causes it to now contact the activator arm on the side distal to its region of contact 84.

Figure 20:
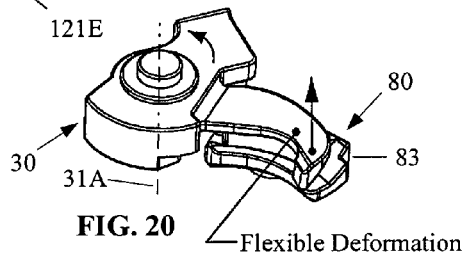
FIG. 20 is a detail view of both the activator arm and the trigger of FIG. 19, illustrating the direction of deformation by the engagement arm of the trigger necessary for the trigger to move past the contact region of the activator arm.

In order for the trigger 30 to continue rotating to return to a position proximal to the contact region 84 of the activator arm 80 to be able to drive it once again (as in FIGS. 16 and 17), the trigger arm 33 may be constructed so as to be able to deform elastically to move over the top of, and relative to, the activator arm. Since the trigger arm 33 must still possess the rigidity necessary to be able to drive the activator arm 80 at the appropriate sequence of movement of those components, the trigger arm may be constructed to be wide, in order to possess the requisite cross-sectional moment of inertial for applying a driving force normal to the axis 31A of the trigger 30. But the trigger arm may be fairly thin, so as to be flexible in a direction parallel to the axis 31A. In additional, the trigger arm 33 may be constructed of a material that may exhibit a certain degree of resiliency, particularly for thin sections. When so constructed, the trigger arm 33, as seen in FIG. 20, may elastically deform in a direction that is parallel to the axis 31A of rotation of the trigger to clear the activator arm 80, after which it may elastically return to its original un-deformed or un-deflected position.

To better enable the trigger arm 33 to be restored once clear of the activator arm, a second embodiment in the form of sash lock 6 may be constructed the same as sash lock 5, but may include a leaf spring 112. Leaf spring 112 may serve to bias the trigger arm 33 downward to assured proper engagement with the activator arm 80 at the appropriate time.

Locking of the sash lock 5 or 6 is as previously described, in which the tongue 124 of latch member 120 engages the keeper 39. As seen in FIG. 4, the generally rectangular tongue 124 may be received in a generally rectangular recess 40 that is on the same side of the keeper 39 as the angled surface 46. The actual engagement therebetween is visible in the bottom view of FIG. 3.

In addition to this locking aspect, to more rigidly secure the sash lock 5/6 to the keeper 39, the hood 19 of the housing 10 is shaped and positioned so that when the keeper 39 is received by the sash lock with the tongue 124 engaging the recess 40, the hood 19 is in close proximity to the top surface 41 of the keeper (FIG. 9B). Moreover, the down-standing flange 19D that protrudes from the hood 19 may also engage a second recess 42 on a side of the keeper 39 opposite to that of recess 40 (see FIGS. 5, 2, and 9D-9F). This arrangement, with the flange 19D, hood 19, and tongue 24 surrounding three sides of the periphery of the keeper 39, and engaging two of those three sides, serves to prevent forced disengagement of the latch from the keeper by an intruder.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

We claim:

1. An automatically re-locking sash lock, said sash lock comprising:

a housing;

a latch member, said latch member being slidable within said housing, between a locked position where a portion of a first end of said latch member protrudes from a portion of said housing, and an unlocked position where said protruding portion of said first end of said latch member is retracted into said housing;

a biasing means, said biasing means configured to bias said latch member toward said locked position;

an activator arm, said activator arm being pivotally mounted within said housing;

a trigger member; said trigger member being pivotally mounted within said housing, said trigger member comprising a first arm and a second arm;

a torsion spring, said torsion spring configured to bias said trigger member relative to said activator arm, said relative biasing configured to cause said activator arm to rotate and contact a first portion of said latch member, to releasably secure said latch member in said unlocked position; and said relative biasing configured to cause said trigger member to rotate, to drive a portion of said second arm to protrude out from said housing; and said protruding portion of said second arm of said trigger member comprising an angled surface configured to be actuated to cause said trigger member to counter-rotate, to cause said first arm of said trigger member to releasably engage said activator arm to thereby drive said activator arm to counter-rotate and disengage from said first portion of said latch member, for said biasing means to automatically bias said latch member into said locked position.

2. The automatically re-locking sash lock according to claim 1, wherein said angled surface of said protruding portion of said second arm of said trigger member is configured for further actuation to cause continued counter-rotation thereto, to cause disengagement of said first arm of said trigger member from said activator arm, for said biasing means to automatically bias said activator arm to rotate into contact with a second portion of said latch member.

3. The automatically re-locking sash lock according to claim 2, wherein said disengagement of said trigger member from said activator arm is by said engagement therebetween comprising a small region of contact, and by a tangential direction of movement of said small contact region on said trigger member configured to diverge away from a tangential direction of movement of said small contact region of said activator arm, to cause said trigger to disengage from said activator arm to be on a side of said activator arm being distal from said small region of contact.

4. The automatically re-locking sash lock according to claim 3, wherein when said latch member is moved into said unlocked position, and said activator arm is biased into contact with said first portion of said latch member, for said releasable securement of said latch member in said unlocked position, and when said angled surface of said protruding portion of said second arm of said trigger member is no longer actuated, said relative biasing is further configured to cause said trigger member to rotate relative to said activator arm and to drive a portion of said second arm to deflect over said activator arm, to move from said distal side of said activator arm contact region to contact said latch member, and to be proximal to said small region of contact on said activator arm.

5. The automatically re-locking sash lock according to claim 4, wherein said second arm of said engagement member is configured to elastically deflect to move over said activator arm.

6. The automatically re-locking sash lock according to claim 2, further comprising a visual signal being positioned on a surface of said latch member, and a signal plate being hinged to said housing; and wherein when said latch member is moved into said locked position, said signal plate is thereby driven by said latch member to rotate to mask said visual signal; and wherein when said latch member is moved into said unlocked position, said signal plate is thereby driven by said latch member to counter-rotate to reveal said visual signal.

7. The automatically re-locking sash lock according to claim 6, wherein said visual signal comprises a visual signal from the group of visual signals consisting of: a bright color, and a printed warning.

8. The automatically re-locking sash lock according to claim 1 further comprising a signal means, said signal mean configured to indicate when said latch member is in said locked position, and to indicate when said latch member is in said unlocked positions.

9. A sash lock comprising:

a housing; said housing comprising one or more walls to create a cavity, at least a portion of said one or more walls having an opening into said cavity;

a latch member, at least a portion of said latch member being slidably disposed within said housing, and being slidable between a locked position where a portion of a first end of said latch member protrudes from a portion of said housing, and an unlocked position where said protruding portion of said first end of said latch member is retracted into said housing;

a biasing means, said biasing means configured to bias said latch member toward said locked position;

an activator arm, said activator arm being pivotally mounted within said housing cavity;

a trigger member; said trigger member being pivotally mounted within said housing cavity; said trigger member comprising a trigger arm extending away from one portion of said trigger member, and an engagement arm extending away from a second portion of said trigger member;

a torsion spring, said torsion spring configured to bias said trigger member relative to said activator arm, said relative biasing configured to bias said activator arm to rotate and contact a first portion of said latch member, to thereat oppose said bias of said biasing means to releasably secure said latch member in said unlocked position; and said relative biasing configured to normally bias said trigger member to rotate, to drive a portion of said trigger arm to protrude out from said housing; and said protruding portion of said trigger arm comprising an angled surface configured to be actuated to cause said trigger member to counter-rotate, to cause said engagement arm of said trigger member to releasably engage said activator arm to thereby drive said activator arm to counter-rotate and disengage from said first portion of said latch member, for said biasing means to automatically bias said latch member back into said locked position.

10. The sash lock according to claim 9 further comprising a signal means, said signal means configured to indicate when said latch member is in said locked position, and when said latch member is in said unlocked position.

11. The sash lock according to claim 9 further comprising a cover plate, said cover plate being secured to said housing to thereby cover at least a portion of said opening in said one or more housing walls; and wherein said pivotal mounting of said trigger member comprises first and second posts extending from opposite sides of said trigger member, said first post being received in an orifice in said housing, and said second post being received in an orifice in said cover plate.

12. The sash lock according to claim 11, wherein said activator arm is pivotally mounted within said housing cavity by an orifice on said activator arm receiving a post protruding from said housing; and with at least a portion of said activator arm being disposed between said housing and said trigger member.

13. The sash lock according to claim 9, wherein said angled surface of said protruding portion of said trigger arm is configured for further actuation that causes continued counter-rotation of said trigger, to cause disengagement of said engagement arm of said trigger member from said activator arm, for said biasing means to automatically bias said activator arm to rotate into contact with a second portion of said latch member.

14. The sash lock according to claim 13, wherein said disengagement of said engagement arm from said activator arm is by said engagement therebetween comprising a small region of contact, and by a direction of movement of said small contact region on said engagement arm configured to diverge from a direction of movement of said small contact region on said activator arm, to cause said trigger to disengage from said activator arm to be on a side of said activator arm being distal from said small region of contact.

15. The sash lock according to claim 14, wherein when said latch member is moved into said unlocked position, and said activator arm is biased into contact with said first portion of said latch member, for said releasable securement of said latch member in said unlocked position, and when said angled surface of said protruding portion of said trigger arm is no longer actuated, said relative biasing is further configured to cause said trigger member to rotate relative to said activator arm and to drive a portion of said second arm to deflect over said activator arm, to move from said distal side of said activator arm contact region to contact said latch member, and to be proximal to said small region of contact on said activator arm.

16. The sash lock according to claim 15, wherein said engagement arm of said engagement member is configured to elastically deform to move over said activator arm.

17. The sash lock according to claim 13, further comprising a visual signal being positioned on a surface of said latch member, and a signal plate being hinged to said housing; and wherein when said latch member is moved into said locked position, said signal plate is thereby driven by said latch member to rotate to mask said visual signal; and wherein when said latch member is moved into said unlocked position, said signal plate is thereby driven by said latch member to counter-rotate to reveal said visual signal.

18. The sash lock according to claim 17, wherein said visual signal is a visual signal from the group of visual signals consisting of: a bright color, and a printed warning.

* * * * *